US012398620B2

(12) United States Patent
Russell et al.

(10) Patent No.: US 12,398,620 B2
(45) Date of Patent: Aug. 26, 2025

(54) DENSITY BASED INFLOW CONTROL DEVICE, METHOD, AND SYSTEM

(71) Applicant: Baker Hughes Oilfield Operations LLC, Houston, TX (US)

(72) Inventors: Ronnie Russell, Cypress, TX (US); Daniel Ewing, Katy, TX (US); Guijun Deng, The Woodlands, TX (US); Rowland Moffatt, Humble, TX (US); Meghana Annamalai Dhandayuthapani, Tamilnadu (IN)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/363,075

(22) Filed: Aug. 1, 2023

(65) Prior Publication Data

US 2025/0043657 A1 Feb. 6, 2025

(51) Int. Cl.
*E21B 34/10* (2006.01)

(52) U.S. Cl.
CPC ..... *E21B 34/10* (2013.01); *E21B 2200/02* (2020.05)

(58) Field of Classification Search
CPC ..... E21B 43/12; E21B 43/38; E21B 34/10
See application file for complete search history.

(56) References Cited

U.S. PATENT DOCUMENTS 5,044,398 A * 9/1991 Mock ..... E21B 44/06 137/596.2
5,961,841 A * 10/1999 Bowers ..... E21B 43/38 210/195.1
6,000,468 A * 12/1999 Pringle ..... E21B 47/10 137/101.21
9,683,429 B2 6/2017 Mathiesen et al.
10,060,221 B1 * 8/2018 Rong ..... E21B 43/12
2006/0076150 A1 * 4/2006 Coronado ..... E21B 43/32 166/250.15
2006/0186038 A1 * 8/2006 Nassif ..... B04C 5/12 210/512.3

(Continued)

FOREIGN PATENT DOCUMENTS

EP 2333235 A1 6/2011
WO 2020139387 A1 7/2020

OTHER PUBLICATIONS

HPHT Wells, Tony Smithson Senior Editor; The Defining Series, Oilfield Review 2016, 2 pages; www.slb.com/defining.

(Continued)

*Primary Examiner* — Shane Bomar
(74) *Attorney, Agent, or Firm* — Baker Hughes Patent Organization

(57) ABSTRACT

An inflow control device including a valve responsive to pressure inputs, and a fluid discriminator having a first structure that supports a first flow regime and a second structure that changes the flow regime to exhibit a higher pressure, a first pressure tap at the first structure and a second pressure tap at the second structure, the taps experiencing a differential pressure that is different for water and for oil flowing through the discriminator, and the first and second pressure taps connected to the valve. A borehole system, including a borehole in a subsurface formation, a string in the borehole, and an inflow control device disposed within or as a part of the string.

20 Claims, 13 Drawing Sheets

(56) References Cited

U.S. PATENT DOCUMENTS

| | | | | |
|---|---|---|---|---|
| 2008/0041588 | A1 | 2/2008 | Richards et al. | |
| 2015/0053417 | A1* | 2/2015 | Holderman | E21B 34/08 166/373 |
| 2015/0060084 | A1* | 3/2015 | Moen | E21B 43/08 166/321 |
| 2015/0167413 | A1* | 6/2015 | Leuchtenberg | E21B 21/106 166/357 |
| 2016/0215598 | A1* | 7/2016 | Lopez | E21B 43/088 |
| 2018/0245429 | A1* | 8/2018 | Bhadbhade | E21B 34/06 |
| 2021/0002978 | A1* | 1/2021 | Killie | E21B 43/12 |
| 2021/0062648 | A1* | 3/2021 | Tian | E21B 47/10 |
| 2021/0333186 | A1* | 10/2021 | Greci | G01N 9/26 |
| 2022/0403719 | A1* | 12/2022 | Zhang | E21B 43/12 |
| 2023/0051577 | A1* | 2/2023 | Manning | F16K 31/1221 |
| 2024/0019878 | A1* | 1/2024 | Mathiesen | G05D 7/0113 |

OTHER PUBLICATIONS

Notification of Transmittal of the International Search Report and the Written Opinion of the International Searching Authority, or the Declaration; PCT/US2024-040521; Mail Date: Nov. 18, 2024; 13 pages.

* cited by examiner

DENSITY BASED INFLOW CONTROL DEVICE, METHOD, AND SYSTEM

BACKGROUND

In the resource recovery industry, flow control devices and particularly inflow control devices are widely used to manage fluid flows into the wellbore system. Many are viscosity-based devices and these work well for their intended purposes but do not provide sufficient discriminatory action for all applications. The art would well receive alternate technologies that improve control.

SUMMARY

An embodiment of an inflow control device including a valve responsive to pressure inputs, and a fluid discriminator having a first structure that supports a first flow regime and a second structure that changes the flow regime to exhibit a higher pressure, a first pressure tap at the first structure and a second pressure tap at the second structure, the taps experiencing a differential pressure that is different for water and for oil flowing through the discriminator, and the first and second pressure taps connected to the valve.

An embodiment of a borehole system, including a borehole in a subsurface formation, a string in the borehole, and an inflow control device disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
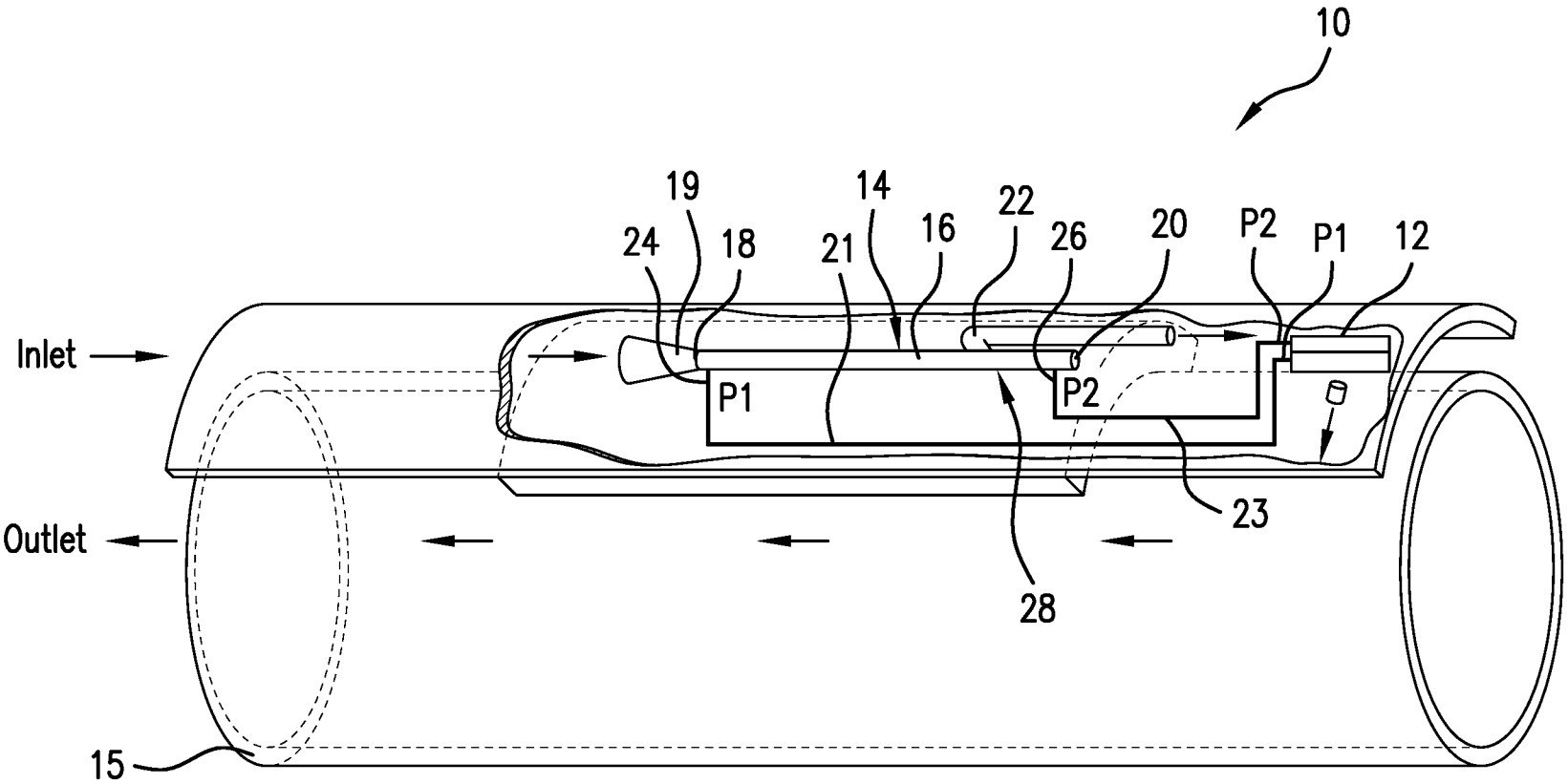
FIG. 1 is a schematic partial section view of an inflow control device as disclosed herein.
Figure 2:
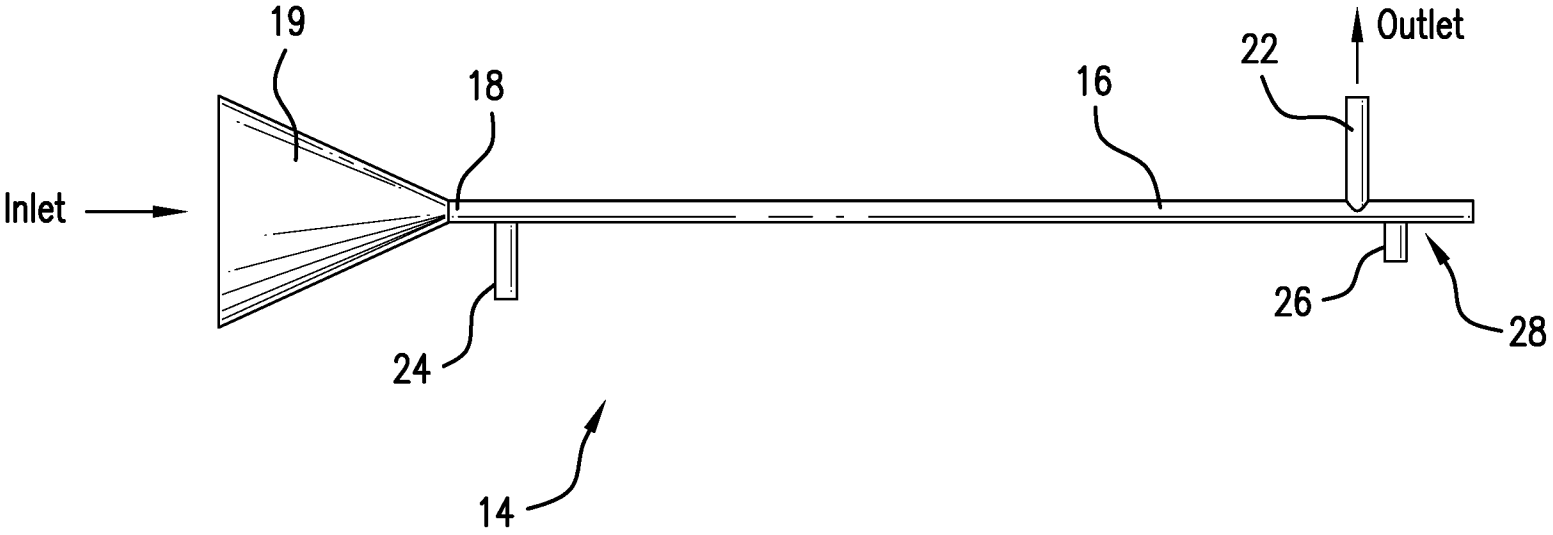
FIG. 2 is a schematic view of a fluid discriminator as disclosed herein that is a part of the inflow control device that is disclosed herein.

Referring to FIGS. 1 and 2, one embodiment of an inflow control device 10 is illustrated. Device 10 includes a valve 12 that is responsive to pressure inputs and a fluid discriminator 14. These can be disposed in or on a basepipe 15 as illustrated and may be proximate one another or may be spaced from one another depending upon desired length of pressure conduits 21 and 23 used to connect the valve 12 and the discriminator 14. The valve 12, in embodiments, may be a diaphragm-type valve, a disk valve, a piston valve, or any similar valve that is responsive to a differential pressure supplied similarly to that depicted in FIG. 1 to move a component thereof between a position where a primary flow through the valve 12 is encouraged and where the primary flow through the valve is discouraged. The fluid discriminator 14 comprises flow configuration 16, such as a Bernoulli tube, that is open at one end at inlet 18 to a source of fluid such as a reservoir fluid. Optionally, in some embodiments, a larger entry manifold 19 may be used but it is not required for the effects described herein.

The reservoir fluid, or any other fluid, that flows in the configuration 16 will experience friction and turbulence along the configuration. Resultantly, fluid flowing in the configuration 16 will exhibit a lower pressure than that of the source fluid. The magnitude of the change in pressure is related to the density of the fluid that is flowing in the configuration 16.

As illustrated, the discriminator 14 further includes, at an end opposite the inlet end 18, a closed end 20 and another path 22 for flow that Tees off from the configuration 16 between inlet 18 and end 20. The Tee may have an inner diameter equal to, greater than, or smaller than the inner diameter of the adjacent tubes. In an embodiment, fluid flowing through configuration 16 and path 22 is ultimately either produced or inhibited depending upon the position of valve 12, which is dependent upon the pressure differential across a first pressure tap 24 and a second pressure tap 26 disposed in the discriminator 14. Path 22 could also be configured as a pilot path that remains open regardless of the inputs on the valve and different supply path would in that case act as the primary pathway when the valve 12 is open. The taps 24 and 26 experience different pressure differential based upon a density of the fluid flowing in the configuration 16. In the case of water and oil, the difference in differential pressure may be, for example, 10 pounds per square inch (PSI), depending upon the ratio of length to inside diameter of the configuration 16. The taps 24 and 26 experience a greater or lesser pressure differential depending upon a greater or lesser percentage of a target fluid (oil or water) in the source fluid connected to the discriminator 14 and flowing therethrough. The difference in differential pressure is used to cause the valve 12 to move in the direction it is desired that it move (based upon which side the P1 [associated with 24] and P2 [associated with 26] are connected to). It may be that the pressure-based movement causes the valve to close or it may be that the same pressure differential causes the valve to open. This can also be reversed by swapping the pressure tap connections. The pressure differential alone may be the only driving factor for the valve 12 in some embodiments but in other embodiments that include spring(s), the spring(s) bias may need to be overcome to move the piston or disk.

In one example, the pressure at tap 24 minus the tap pressure at tap 26 for water flowing in the configuration 16 is zero. The valve 12 will stay wherever it was or will remain biased only by the one or more springs. When oil flows through the configuration 16 however, the pressure at tap 24 minus the pressure at tap 26 will yield a nonzero result, which means that a hydraulic force will be generated on the valve 12 to move a piston or disk, for example, toward the P1 or P2 that is lower pressure than the other of P1 or P2. This, again, may be against biasers or without biasers (springs).

Resultantly, the inflow control device 10 will automatically reduce flow through the valve 12 if a nontarget fluid is the majority of fluid flowing through the discriminator 14 and automatically increase flow through the valve 12 if a target fluid is the majority of fluid flowing through the discriminator 14. In embodiments the fluid is water or oil but others could be substituted. Also, which is the target, oil or water, may be selected and the overall device 10 will function as required.

Tap 24 is positioned to be adjacent the inlet 18 such that pressure is likely the same as source pressure. It will be appreciated that flow through the configuration 16 will result in continuously reducing pressure all along the tube. Hence, the closer to the inlet 18 the better for tap 24 to ensure the pressure measured there is close to source pressure. Tap 26 is placed in a stagnation zone 28. Stagnation is where pressure is recovered due to a lack of flow, such as in a plugged tubing section extending from configuration 16, or a stagnant area of a turn in the flow, such as that illustrated between 18 and 22 (the outside corner of this flow transition will be stagnant because the flow is turning to path 22 and flow is stalled in the corner).

Selecting parameters of the configuration 16 may be accomplished by:

Calculating a Dynamic Pressure=$\rho*V^2/(2*g_c)$ which is the pressure rise magnitude in the stagnation zone, P3, where flow of velocity, V, comes to a stop at a stagnation point (see FIG. 2 SP).

Calculating a tube length (by iterating) that gives a pressure drop along the tube (using the Darcy-Weisbach equation) equal to the dynamic pressure rise (i.e. P1-P3=0).

Slightly adjusting the tube length shorter or longer to cause there to be a pressure drop sign reversal for flowing water versus oil. An optimal ratio of tube length to tube diameter is 37.5 for a tube of 0.186 inch inner diameter. The optimal ratio increases as inner diameter increases. A range for the ratio of length to diameter of about 14 to about 58 at atmospheric pressure is sufficient to obtain the benefit of the disclosure hereof. It is noted that the optimal ratio of length to diameter may reduce by as much as 50% (range about 7 to about 29) in a well at depth as hydrostatic pressure increases in the device. This is because the higher than atmospheric pressure experienced by the discriminator induces a more streamlined flow in the Tee by eliminating effects such as cavitation. Cavitation is prevented if the outlet pressure of the device is several times greater than the change in pressure (ΔP) across the inflow control device restrictor (or any flow restriction). The term "at depth" as used herein relates to a pressure range of about 300 pounds per square inch (PSI)—about 30.000 PSI.

The Darcy-Weisbach equation referenced above is:

$$\Delta P = P1 - P2 = \rho * g * ((f * L/(2 * Dh * g)) * V\hat{}2 + \Delta Z)/g_c$$

Where ΔP=Pressure in-Pressure out=Pressure Drop ($N/m^2$)

V=Flow Velocity (m/s)

Dh=Hydraulic Diameter (m)=4*Area/(Wetted Perimeter)

L=Pipe Length (m)

g=gravity ($m/s^2$)

$g_c$=Gravitational Proportionality Constant, $g_c$=1 (kg m/s^2)/N for SI, $g_c$=32.174 (lbm ft/s^2)/lbf for British ρ=Density ($kg/m^3$)

ΔZ=Height Z2–Z1=Elevation Change (m) (positive if flowing uphole)

f=Darcy Friction Factor (no units), from Moody Chart. or use Chen equation, which is:

for laminar flow, Re<2300 f=64/Re for turbulent flow, Re>=2300 f=(1/(−2*LOG 10 ((e/Dh)/3.7065−5.0452*(LOG 10 ((e/Dh)^1.1098/2.8257+ (5.8506/Re^0.8981)))/Re)))^2

ε=Roughness Height (1.016e-5 m, or 0.0004 inch for machined surfaces)

ε/Dh=Relative Roughness

Re=ρ*V*Dh/m=Reynold's Number

μ=Dynamic Viscosity

Selecting a tubing length and inside diameter for the configuration 16 will yield acceptable differential pressures to adequately actuate the valve 12 in a direction of the builders choosing to increase flow when a target fluid is prevalent and decrease flow when a nontarget fluid is prevalent.

An inner diameter of 0.186 inch was tested in one embodiment flowing 5.08 gpm water flow rate. A tubing length of about 6.97 inch was found to be optimal for discriminating between oil (kerosene) and water at room temperature. This is an optimal ratio of length to diameter of 37.5. The flow outlet pressure was 1 atmosphere in this embodiment and probably experienced some amount of cavitation where flow turns at the Tee. Computational fluid dynamics (CFD) simulation indicates that under higher hydrostatic pressures or higher downstream pressure, cavitation is eliminated and in this case reducing tube length by about 50% may be more optimal, for example as used in oil wells.

Figure 3:
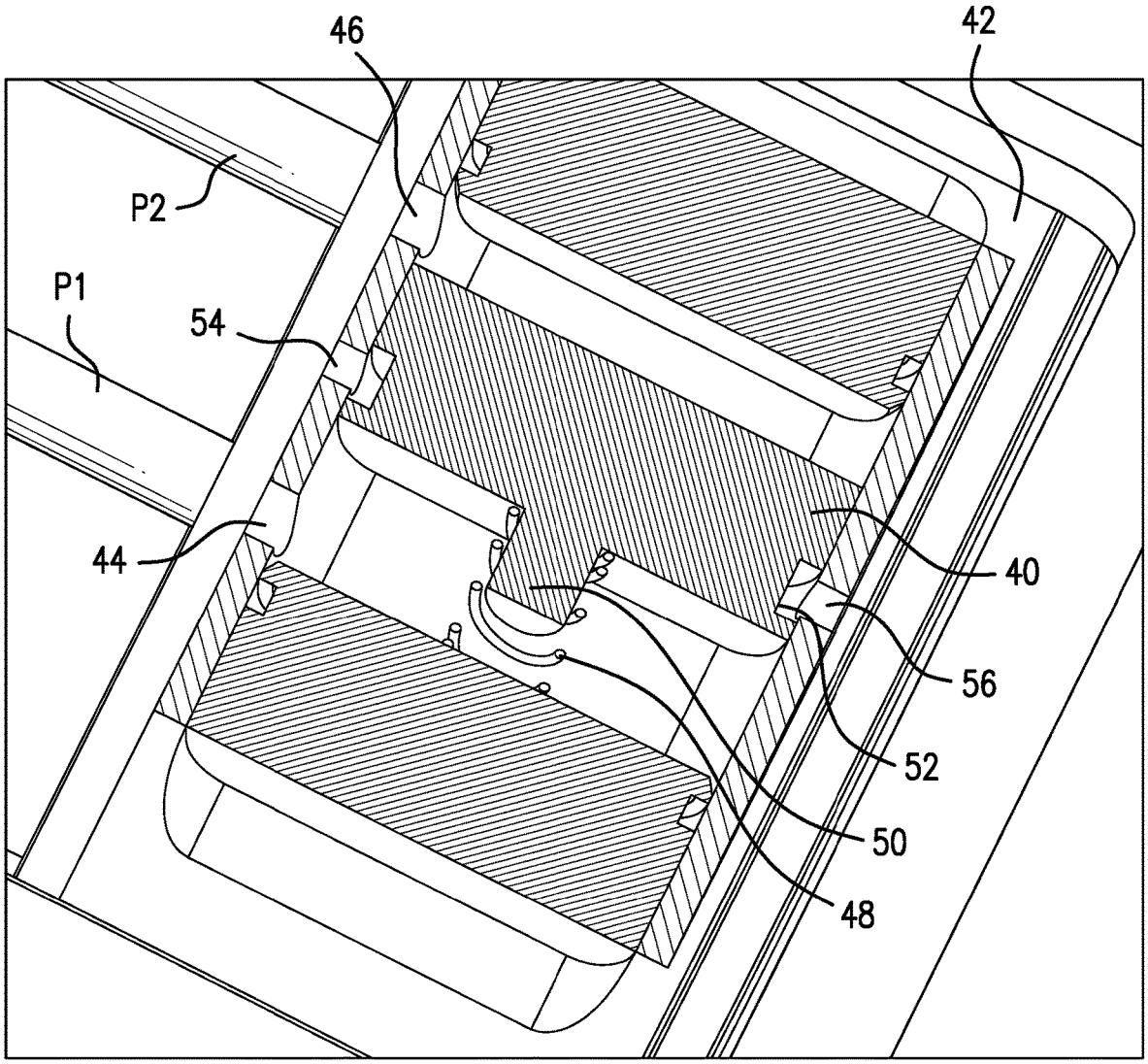
FIGS. 3-11 are various embodiments of the valve of the device as disclosed herein.

Referring to FIGS. 3-11, various sectional views of valve 12 are illustrated. It will be appreciated that FIGS. 3-7 are quite similar to one another with small variations that are pointed out below in an abbreviated manner after identification of elements that have been discussed above is made with regard to FIG. 3. Valve 12 as illustrated in FIG. 3 is a piston-type valve including a piston 40 in a housing 42. The housing 42 includes inputs for P1 through tube 21 and P2 through tube 23 at 44 and 46, respectively. Piston 40 is biased in this embodiment by a spring 48 and may include a locating pin 50. About the piston 40 is a flow groove 52 that aligns with a primary inflow port 54 and a primary outflow port 56. When piston 40 is in the position illustrated, there is flow continuity from port 54 to port 56. When the pressure in line P2 is greater than that of line P1, the piston 40 will move in the direction toward 44 and misalign the groove 52 with the ports 54 and 56 thereby substantially reducing flow therethrough. In an oil production system, higher pressure in tube 23 (P2) will come from water flowing through the discriminator 14 rather than oil so that the pressure differential generated between tap 24 and 26 will cause the piston 40 movement as described.

Figure 4:
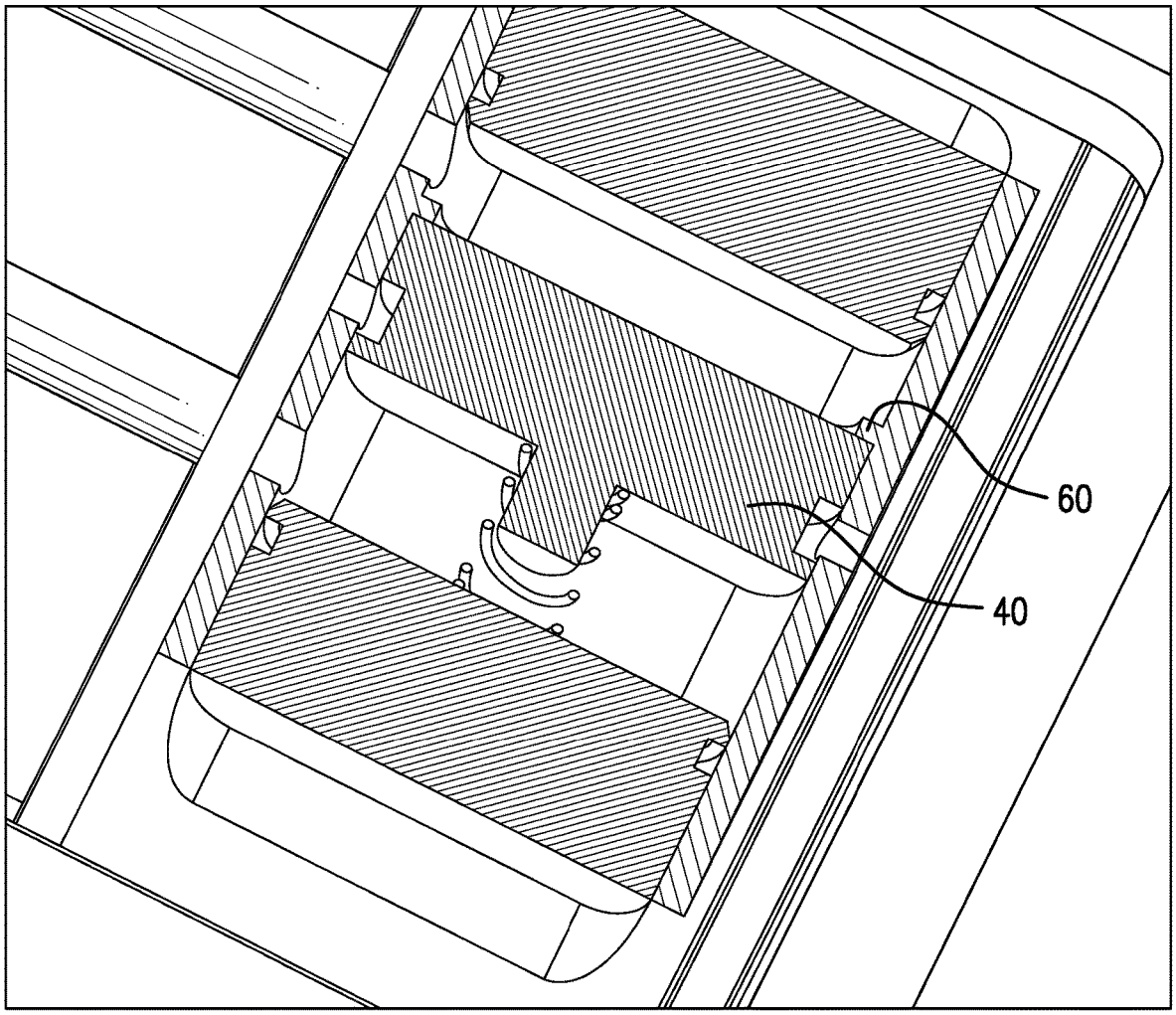

Referring to FIG. 4, the only difference from FIG. 3 is the provision of a limit projection 60 that prevents piston 40 from moving further in that direction after making contact therewith.

Figure 5:
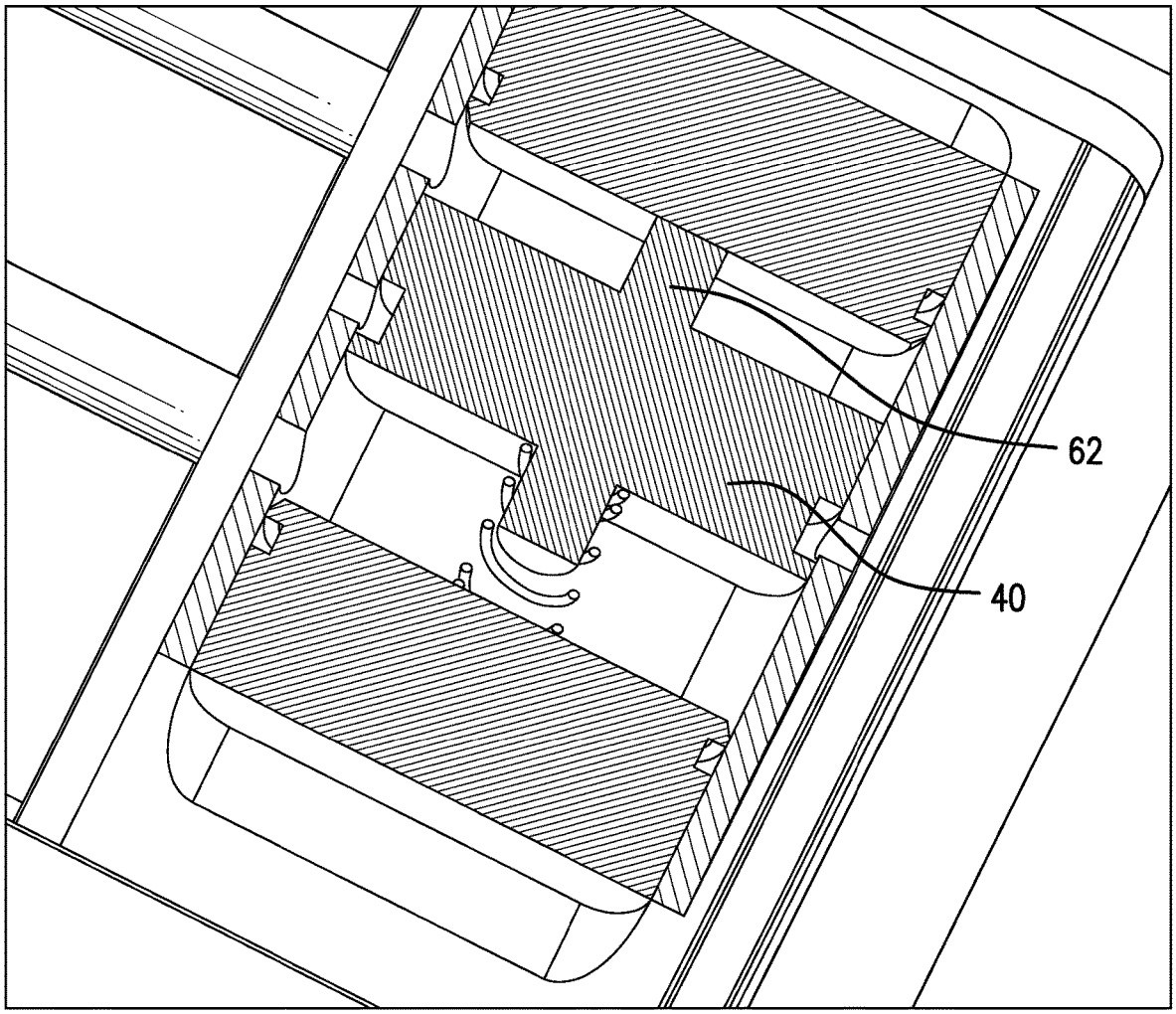

Referring to FIG. 5, an alternate embodiment is illustrated that, like FIG. 4, restricts the piston 40 from moving farther toward the top of the Figure than is desirable. In this embodiment a stop pin 62 is disposed on the piston 40 for this purpose.

Figure 6:
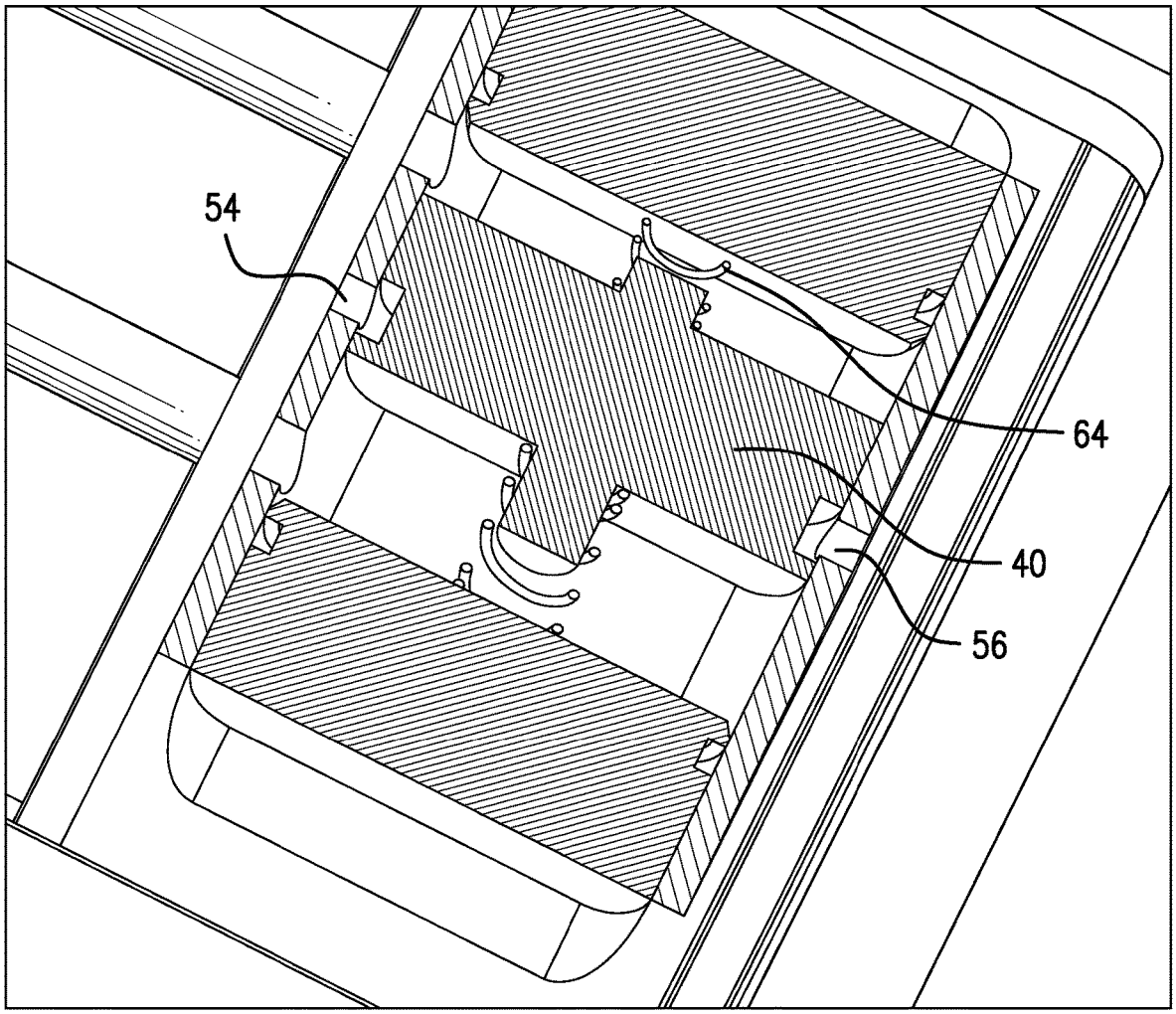

In FIG. 6, another embodiment is illustrated that adds an additional spring 64 to bias the piston 40 toward the valve closed position. This embodiment may be useful to help balance forces created by the differential pressure that are either excessive or insufficient on their own to ensure the appropriate and desired movement of the piston 40 to promote or retard primary fluid flow through ports 54 and 56.

Figure 7:
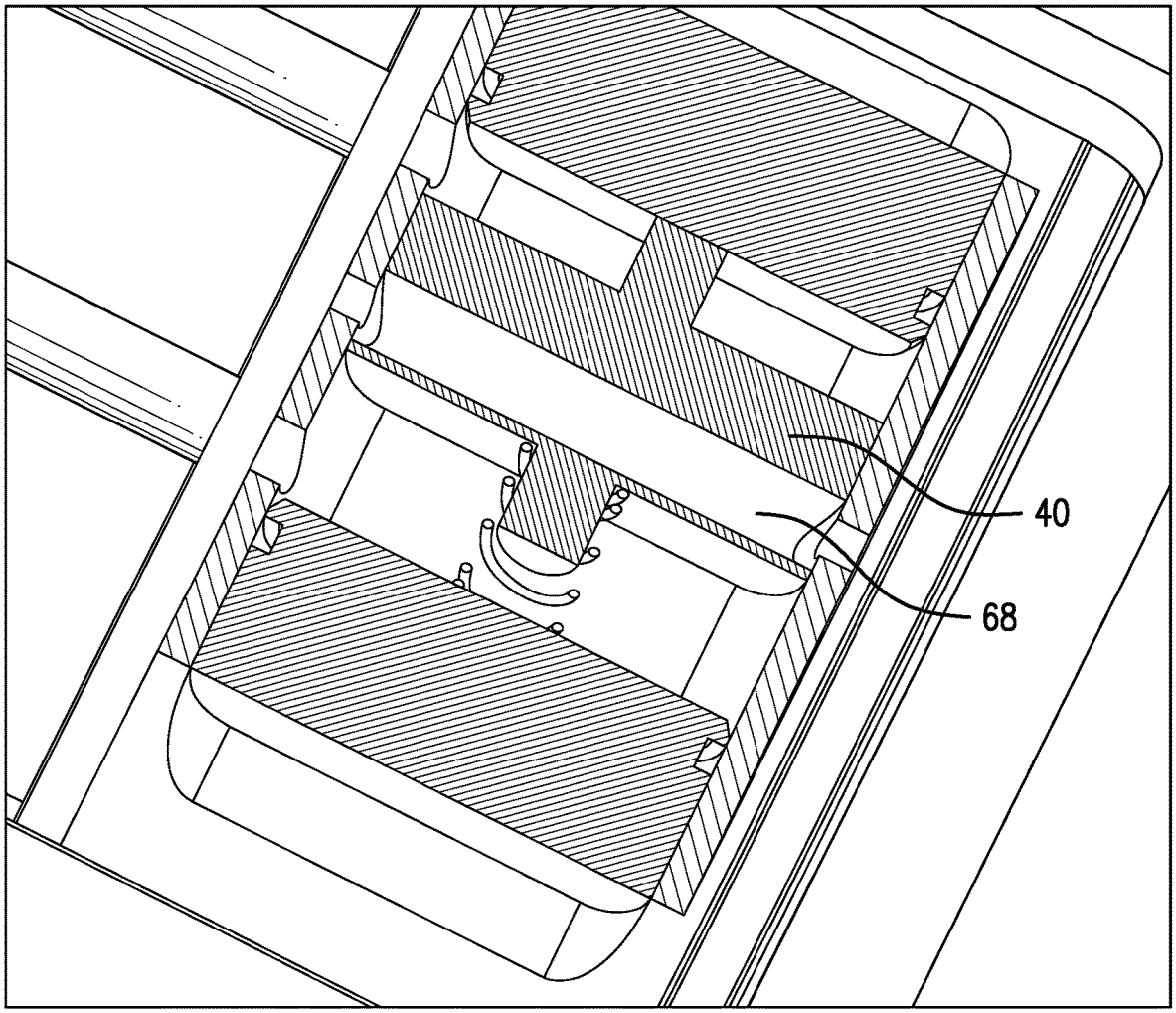
Figure 8:
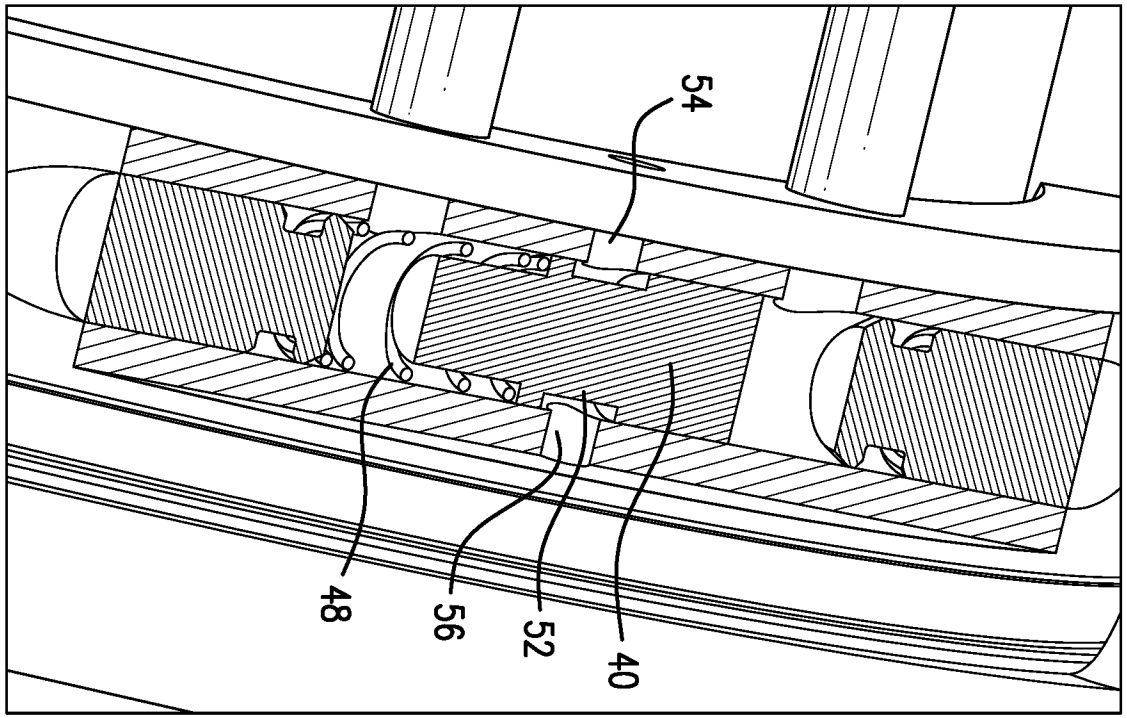
Figure 9:
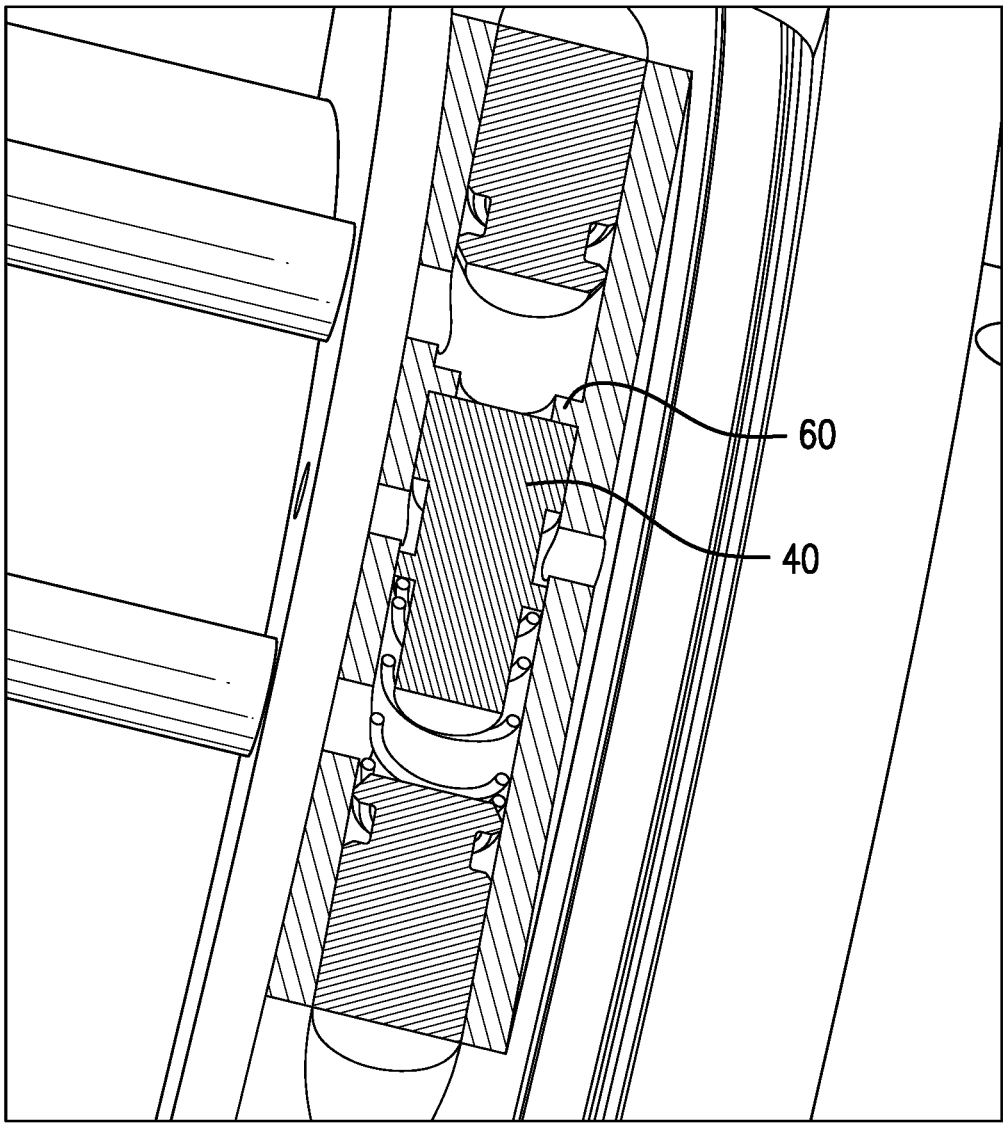
Figure 10:
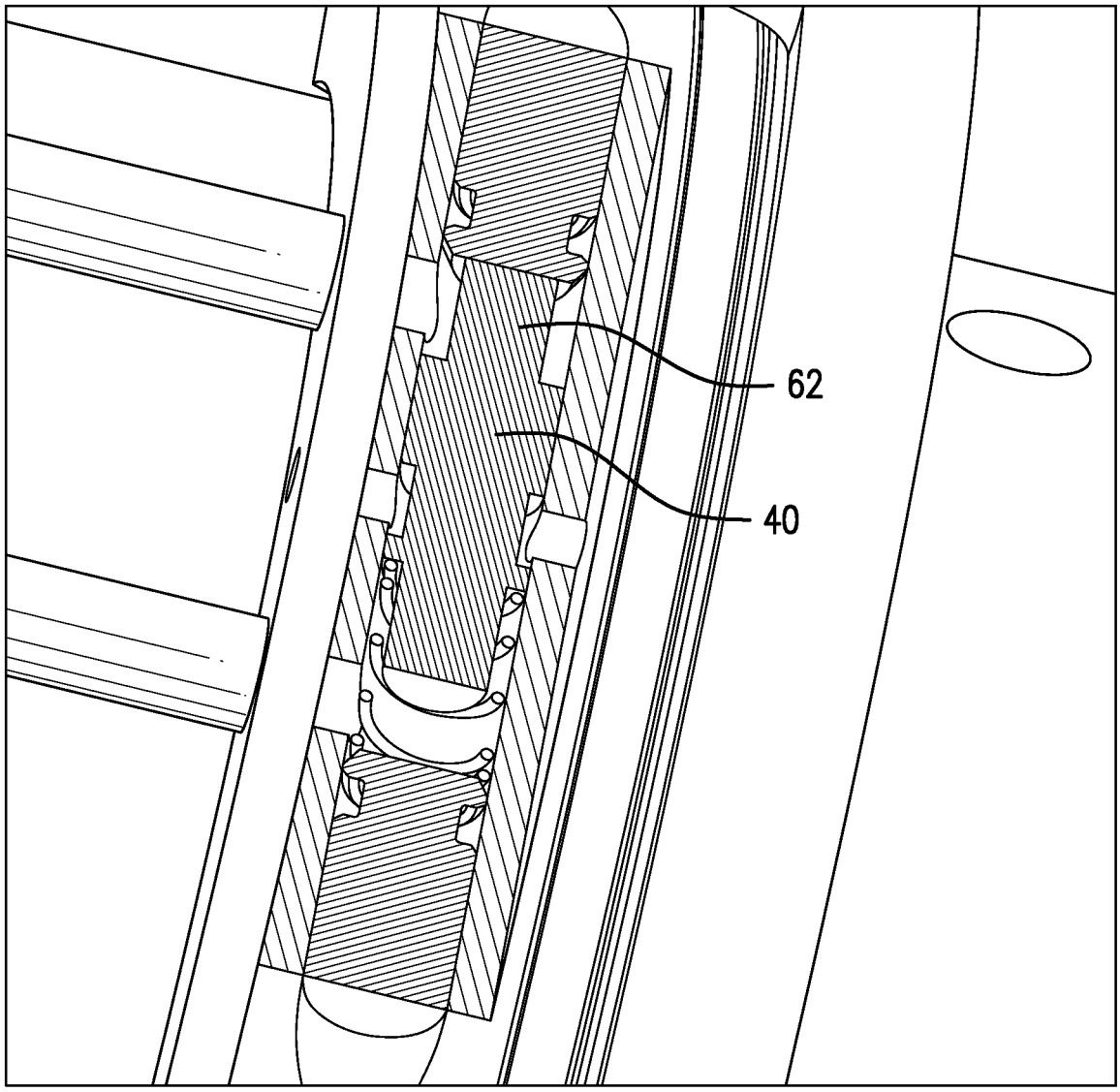
Figure 11:
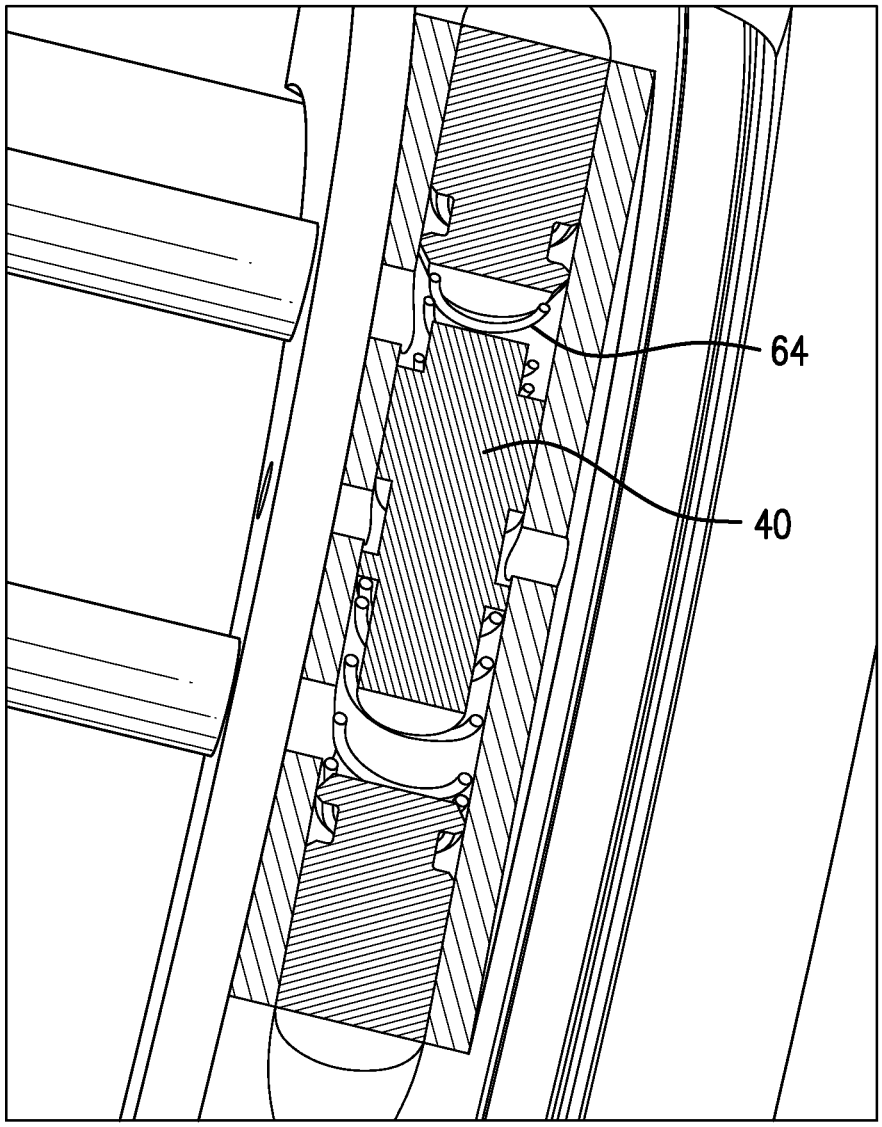

FIG. 7 illustrated a modified piston 40 similar to the foregoing embodiments by lacking a groove 52. Instead of groove 52, a through passage 68 is provided. In other respects, the embodiment is identical to and will function like that of FIG. 5.

FIGS. 8-11 follow a similar pattern to that of FIG. 3-7. The overall shape of piston 40 is circular rather than elliptical or oval as in FIG. 3-7 but the same functionality and features are illustrated except of the through passage 68, which is also contemplated for the circular piston embodiments of FIGS. 8-11. Numerals are the same and descriptions are not repeated due to similarity.

Figure 12:
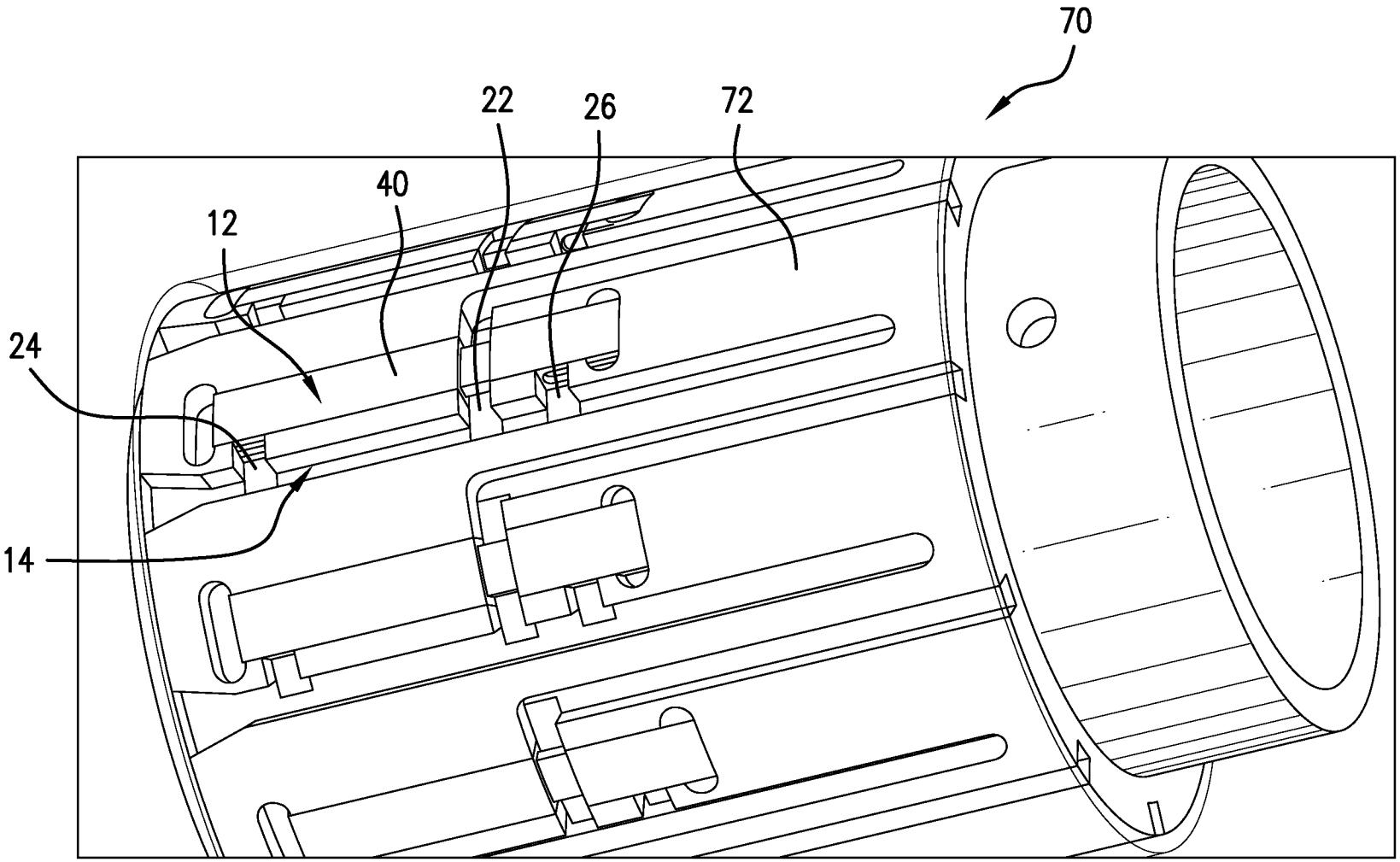
FIG. 12 is an alternative valve structure that includes the discriminator as disclosed herein.

Referring to FIG. 12, another embodiment of valve 12 is illustrated that is configured as a mill-slot-based inflow control device 70. The assembly 70 is annular in nature and still employs the discriminator 14 and the valve 12. It also still uses the pressure taps 24 and 26 and the piston 40. They are simply characterized slightly differently to be functional in an annular housing 72, as illustrated. Having been exposed to the foregoing, one of ordinary skill in the art will readily appreciate the embodiment of FIG. 12 and all of the foregoing disclosure applies thereto. This embodiment functions identically to the foregoing embodiments and also may be configured with the features illustrated in FIGS. 3-11, in similar ways.

Figure 13:
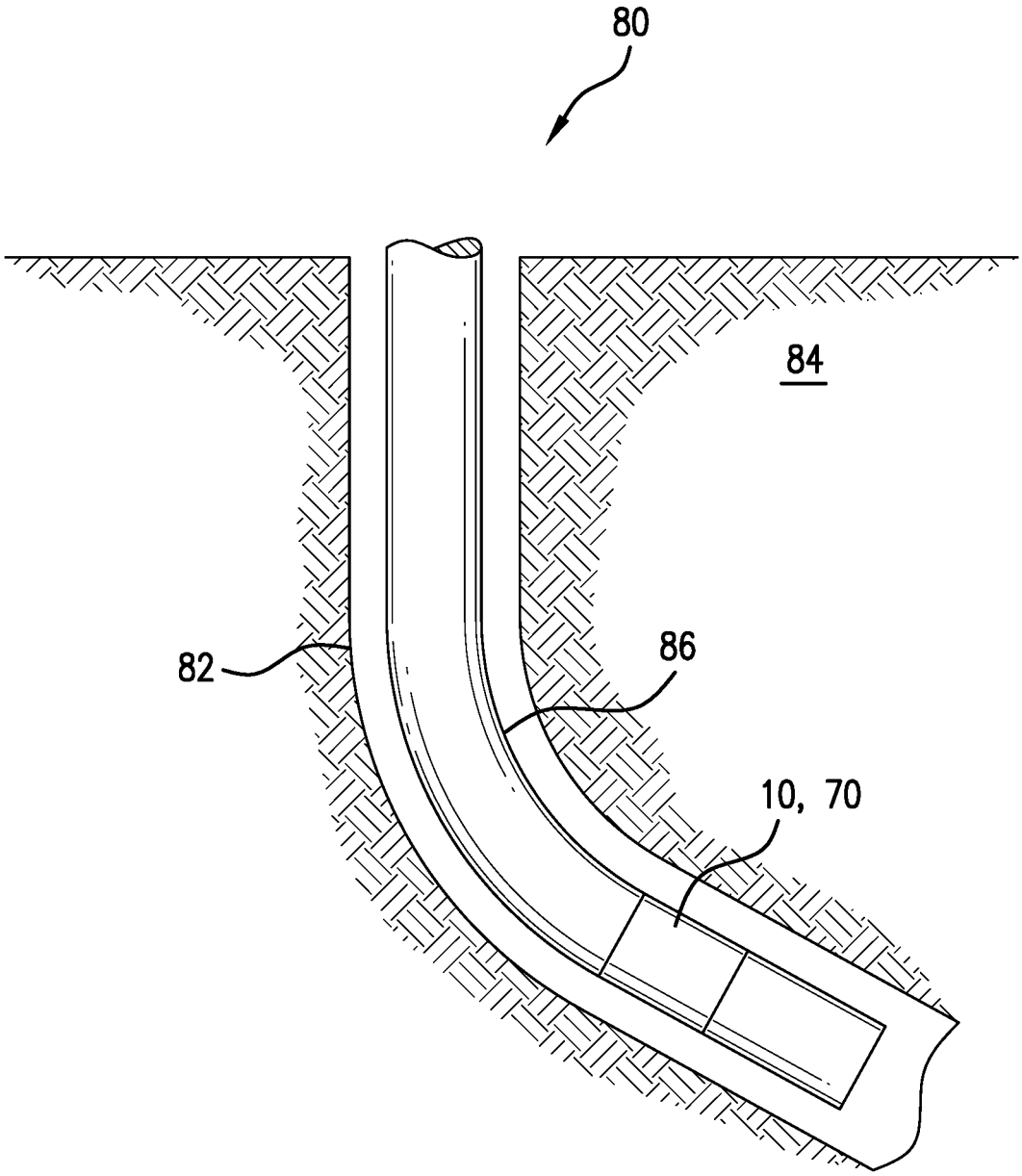
FIG. 13 is a view of a borehole system including the inflow control device as disclosed herein.

Referring to FIG. 13, a borehole system 80 is illustrated. The system 80 comprises a borehole 82 in a subsurface formation 84. A string 86 is disposed within the borehole 82. An inflow control device 10 or 70 as disclosed herein is disposed within or as a part of the string 86.

Set forth below are some embodiments of the foregoing disclosure:

Embodiment 1: An inflow control device including a valve responsive to pressure inputs, and a fluid discriminator having a first structure that supports a first flow regime and a second structure that changes the flow regime to exhibit a higher pressure, a first pressure tap at the first structure and a second pressure tap at the second structure, the taps experiencing a differential pressure that is different for water and for oil flowing through the discriminator, and the first and second pressure taps connected to the valve.

Embodiment 2: The device as in any prior embodiment, wherein the discriminator comprises a Bernoulli tube.

Embodiment 3: The device as in any prior embodiment, wherein the Bernoulli tube is configured with a diameter to length ratio within the range of about 14 to about 58 for pressures of about atmospheric pressure.

Embodiment 4: The device as in any prior embodiment, wherein the Bernoulli tube is configured with a diameter to length ratio within the range of about 7 to about 29 for pressures of about 300 pounds per square inch (PSI)—about 30,000 PSI.

Embodiment 5: The device as in any prior embodiment, wherein the valve is urged by the pressure differential toward an open position when oil is flowing through the discriminator.

Embodiment 6: The device as in any prior embodiment, wherein the valve is urged by the pressure differential toward a closed position when water is flowing through the discriminator.

Embodiment 7: The device as in any prior embodiment, wherein the differential pressure is at a magnitude that overcomes a spring in the valve biasing the valve to an open position.

Embodiment 8: The device as in any prior embodiment, wherein the valve includes a spring.

Embodiment 9: The device as in any prior embodiment, wherein the valve includes spring on both operative ends of a piston or a disk of the valve.

Embodiment 10: The device as in any prior embodiment, wherein the differential pressure is reciprocal for water vs oil.

Embodiment 11: The device as in any prior embodiment, wherein the valve is responsive to move away from the first or second pressure tap depending upon which one has a higher pressure.

Embodiment 12: The device as in any prior embodiment, wherein the second structure is a stagnation branch.

Embodiment 13: The device as in any prior embodiment, wherein the second structure is an expansion area.

Embodiment 14: The device as in any prior embodiment, wherein the valve is a disk valve.

Embodiment 15: The device as in any prior embodiment, wherein the valve is a piston valve.

Embodiment 16: The device as in any prior embodiment, wherein the piston valve is circular in cross section.

Embodiment 17: The device as in any prior embodiment, wherein the piston valve is noncircular in cross section.

Embodiment 18: The device as in any prior embodiment, wherein the piston valve is oval in cross section.

Embodiment 19: The device as in any prior embodiment, wherein the piston valve includes a stop.

Embodiment 20: The device as in any prior embodiment, wherein the piston valve is travel limited by a feature of a housing about a piston of the piston valve.

Embodiment 21: A borehole system, including a borehole in a subsurface formation, a string in the borehole, and an inflow control device as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An inflow control device comprising:

a valve responsive to pressure inputs; and a fluid discriminator having a first structure that supports a pilot flow and a second structure configured as a stagnation branch wherein fluid is stagnated while the pilot flow is flowing during use of the inflow control device;

a first pressure tap at the first structure and a second pressure tap at the second structure, the taps experiencing a differential pressure that is different for water and for oil flowing through the discriminator; and the first and second pressure taps connected to the valve.

2. The device as claimed in claim 1, wherein the discriminator comprises a Bernoulli tube.

3. The device as claimed in claim 2, wherein the Bernoulli tube is configured with a length to diameter ratio within the range of about 14 to about 58 for pressures of about atmospheric pressure.

4. The device as claimed in claim 2, wherein the Bernoulli tube is configured with a length to diameter ratio within the range of about 7 to about 29 for pressures of about 300 pounds per square inch (PSI)—about 30,000 PSI.

5. The device as claimed in claim 1, wherein the valve is urged by the pressure differential toward an open position when oil is flowing through the discriminator.

6. The device as claimed in claim 1, wherein the valve is urged by the pressure differential toward a closed position when water is flowing through the discriminator.

7. The device as claimed in claim 6, wherein the differential pressure is at a magnitude that overcomes a spring in the valve biasing the valve to an open position.

8. The device as claimed in claim 1, wherein the valve includes a spring.

9. The device as claimed in claim 8, wherein the valve includes spring on both operative ends of a piston or a disk of the valve.

10. The device as claimed in claim 1, wherein the differential pressure is reciprocal for water vs oil.

11. The device as claimed in claim 1, wherein the valve is responsive to move away from the first or second pressure tap depending upon which one has a higher pressure.

12. The device as claimed in claim 1, wherein the second structure includes an expansion area.

13. The device as claimed in claim 1, wherein the valve is a disk valve.

14. The device as claimed in claim 1, wherein the valve is a piston valve.

15. The device as claimed in claim 14, wherein the piston valve is circular in cross section.

16. The device as claimed in claim 14, wherein the piston valve is noncircular in cross section.

17. The device as claimed in claim 14, wherein the piston valve is oval in cross section.

18. The device as claimed in claim 14, wherein the piston valve includes a stop.

19. The device as claimed in claim 14, wherein the piston valve is travel limited by a feature of a housing about a piston of the piston valve.

20. A borehole system, comprising:

a borehole in a subsurface formation;

a string in the borehole; and an inflow control device as claimed in claim 1 disposed within or as a part of the string.

* * * * *